US005988578A

United States Patent [19]

Davies

[11] Patent Number: 5,988,578

[45] Date of Patent: Nov. 23, 1999

[54] ROOF MOUNTED SUPPORT BRACKET

[76] Inventor: Robert W. Davies, 3342 Spiceland Dr., Boise, Id. 83704

[21] Appl. No.: 09/003,256

[22] Filed: Jan. 6, 1998

[51] Int. Cl.[6] ..... A47G 29/02

[52] U.S. Cl. ..... 248/237

[58] Field of Search ..... 248/237, 148, 248/238, 236, 188; 182/45, 120, 121; 52/749.12, 749.2, DIG. 12; 403/205, 403

[56] References Cited

U.S. PATENT DOCUMENTS

| | | | |
|---|---|---|---|
| 1,471,947 | 10/1923 | Cornelius | 182/45 |
| 1,586,038 | 5/1926 | Hall | 182/45 |
| 2,320,538 | 6/1943 | Vogt | 304/20 |
| 2,329,415 | 9/1943 | Osborne | 304/20 |
| 3,164,353 | 1/1965 | Rene | 248/237 |
| 4,676,341 | 6/1987 | Shaffstall | 182/45 |
| 4,856,745 | 8/1989 | Mabie | 248/237 |

*Primary Examiner*—Ramon O. Ramirez
*Assistant Examiner*—Tan Le
*Attorney, Agent, or Firm*—Robert L. Shaver; Frank J. Dykas

[57] ABSTRACT

A roof mounted support bracket which provides a horizontal surface on which materials can be loaded by fork lift from ground level. The roof mounted support brackets can be attached either to a truss or to the rafters during the early phases of roof construction or can be mounted to a roof surface after sheathing or other roofing materials have been applied. The roof mounted support bracket is adjustable for varying pitches of roof, and can receive a support brace from below the roof.

5 Claims, 6 Drawing Sheets

ROOF MOUNTED SUPPORT BRACKET

BACKGROUND OF THE INVENTION

1. Technical Field

The present invention generally relates to roof brackets to support load bearing shelves and platforms, and more particularly relates to a roof bracket which can attach to either a member of a roof truss or the surface of the roof itself.

2. Background

There are a number of types of roof brackets which are noted in the prior art, some of which support scaffolds or load bearing shelves. The load bearing shelves can be adapted to support shingles, bricks, roofing materials, or a person who sits on the shelf and applies roofing material. However, none of these devices provide the option of attaching the roof brackets to a roofing truss, before roofing is applied to the truss. Further, none of the prior art roof bracket devices provide an adaptation whereby the roof bracket and the load bearing shelf on it can be braced from below the roof to provide additional support to the structure. Furthermore, none of the prior art roof bracket devices provide the option of attaching to either the roof truss before any roofing material is applied to it, or the roof surface itself after roofing materials such as plywood and shingles have been applied to it.

During the construction of the roof of a building, some of the steps involved include building the structure of the roof using rafters or trusses, then covering the rafters or trusses with a sheathing such as plywood, covering the plywood sheathing with a waterproof material such as tar paper, covering the tar paper with other roof materials such as rolls of asphalt paper, slate or asphalt shingles, sheet metal, or wooden shakes. During each of these stages of building a roof, heavy and bulky roofing materials must be lifted and placed on the often sloping roof so that they can be used over the surface of the roof. These materials can include 4×8 or larger sheets of plywood, rolls of tar paper, boxes of nails, nailing equipment such as power nailers and their air and power cords, five (5) gallon or larger buckets of tar or asphalt, heavy bundles of shingles or sheet metal. These materials can be lifted up one piece at a time, but this is time consuming, expensive, and dangerous, since people can suffer back injuries doing this, or have articles roll or fall off the roof and strike a person below the roof. What is preferable is to lift these articles onto the roof using a fork lift, with the materials on a pallet which can be placed on the roof and left there. This is sometimes not possible because of the slope of the roof. If the materials are left on the pallet supported by a forklift, the forklift and possibly a driver are tied up while it is so utilized.

What is needed is a roof mounted bracket from which can be formed a generally horizontal platform on a sloping roof. If this platform is placed near the edge of the roof, a fork lift from ground level can lift materials onto the roof and deposit them there without risk of injury to the workers from lifting, and reduce the risk of materials rolling off the sloped roof, and without the tieing up of a forklift to hold the materials in place.

Since the first material to be lifted onto the roof is sheathing material such as plywood, it is desirable to have the roof mounted support bracket be able to mount onto the rafters or trusses of a roof in order to except pallets of sheathing material. Once the pallets of sheathing material are deposited on the roof mounted support bracket, the sheathing material can be distributed one sheet at a time over the surface of the roof. When the rafters and trusses of the roof are thus covered with sheathing material, a roof mounted support bracket is needed which can be attached to the sloping roof surface rather than to the sloping edge of the rafter or truss. A preferable device would be a roof mounted support bracket which could first be attached to the sloping rafter or truss edge, and then could be remounted to be attached to the sloping roof surface. Since roofing materials can be quite heavy it is also preferred that braces can be placed below the roof which engage the roof mounted support brackets and help support the load of roofing materials on the load bearing shelf of the roof mounted support bracket.

Accordingly it is the object of the present invention to provide a roof mounted support bracket for attaching to a truss member and for supporting a load bearing shelf. It is another object of the invention to provide a roof mounted support bracket which optionally can attach to either a truss member or to a roof surface.

It is a further object of the present invention to provide a roof mounted support bracket which provides for engagement with a brace placed below the roof to help support the weight of material on the support bracket and the load bearing shelf.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

DISCLOSURE OF INVENTION

These and other objects are accomplished by a roof mounted support bracket which can optionally attach to a truss member or a roof surface, for supporting a load bearing shelf. In one aspect of this invention the roof mounted support bracket is a two sided roof mounted support bracket which includes a generally horizontal leg and a generally vertical leg. The generally horizontal leg and the generally vertical leg adjustably attach to each other at their ends, and the other end of each then attaches to a truss or a roof surface by the use of a roof/truss attachment bracket. The horizontal leg has a first end and a second end. The first end of the horizontal leg hingedly attaches to a first roof/truss attachment bracket. The second end of the horizontal leg adjustably attaches to the second end of the vertical leg. The first roof/truss attachment bracket hingedly attaches to the first end of the horizontal leg in a manner which allows the horizontal leg to rotate. The first roof/truss attachment bracket also attaches to a truss member or to a roof surface.

The vertical leg also has a first end and a second end. The first end hingedly attaches to a second roof/truss attachment bracket. The second end of the vertical end adjustably attaches to the second end of the horizontal leg. The second roof/truss attachment bracket hingedly attaches to the first end of the vertical leg and also attaches to a truss member or a roof surface. A means of adjustably attaching the second end of the horizontal leg to the second end of the vertical leg is provided. One or more generally rectangular brace receivers are also provided which are attached to the first and/or second roof/truss attachment brackets.

One means of adjustably attaching the second end of the horizontal leg with the second end of the vertical leg is by a hole and pin arrangement, in which a Y yoke with holes in it is attached to the second end of the horizontal leg, and corresponding holes are provided in the vertical leg. The Y yoke of the horizontal leg can be moved along the length of the vertical leg until the holes match up and a pin can be inserted.

The roof mounted support bracket can also be a three sided device, with a horizontal leg, a vertical leg, and roof slope leg which is placed parallel to the slope of the truss or roof surface. In this embodiment of the invention, the first and second roof/truss attachment brackets are mounted on either end of the roof slope leg. In this embodiment the generally rectangular brace receivers are attached to the first and/or second roof/truss attachment bracket.

BEST MODE FOR CARRYING OUT INVENTION

Figure 1:
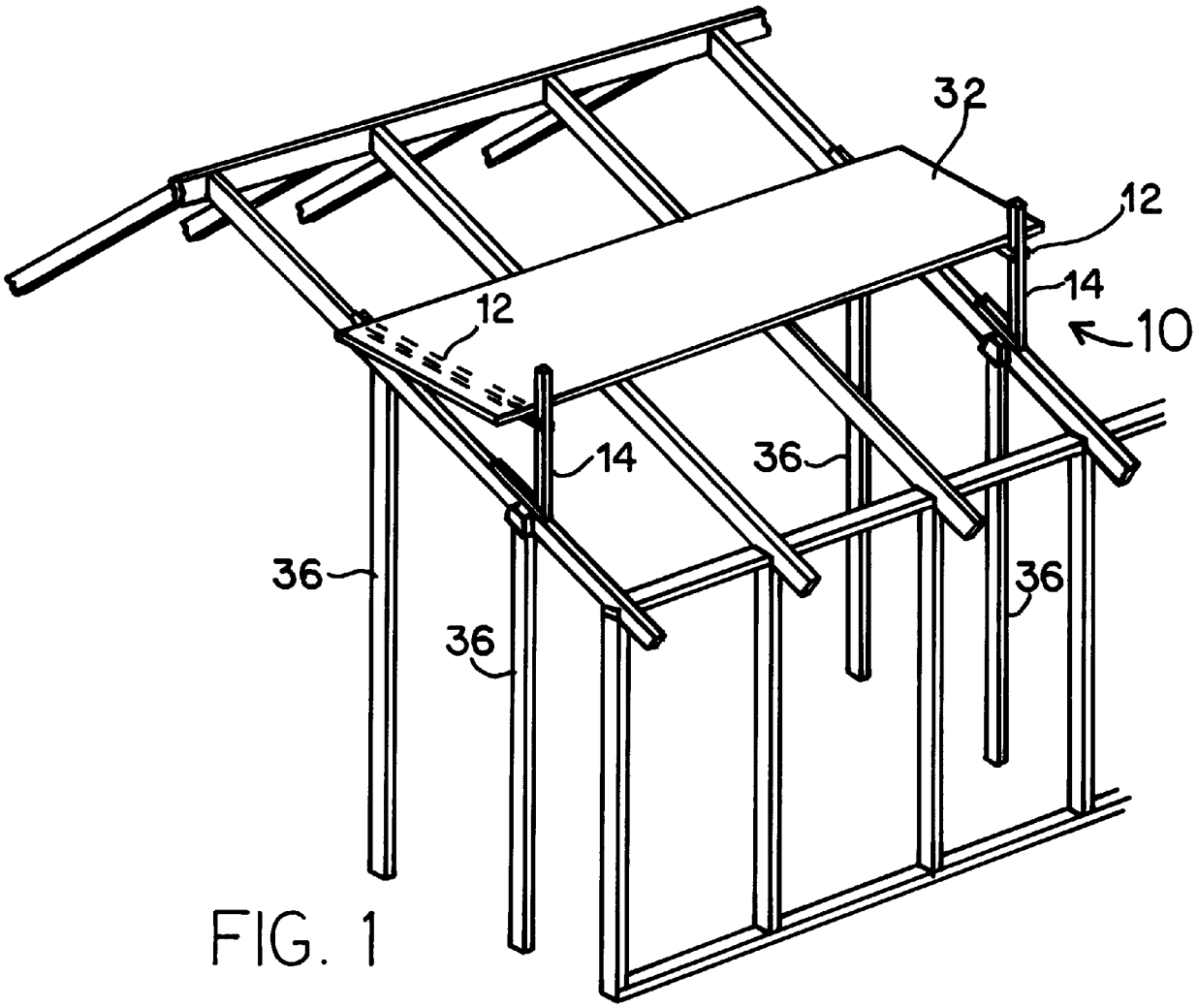
FIG. 1 is a perspective view showing the roof mounted support bracket attached to trusses on a roof and supporting a load bearing shelf.

Two of the preferred embodiments of this invention are illustrated in the figures. FIG. 1 is a prospective view of one of these embodiments of the roof mounted support bracket.

Referring to FIG. 1, roof mounted support bracket 10 is shown. Roof mounted support bracket 10 is preferably made of steel but other metals with suitable characteristics could also be used.

Figure 2:
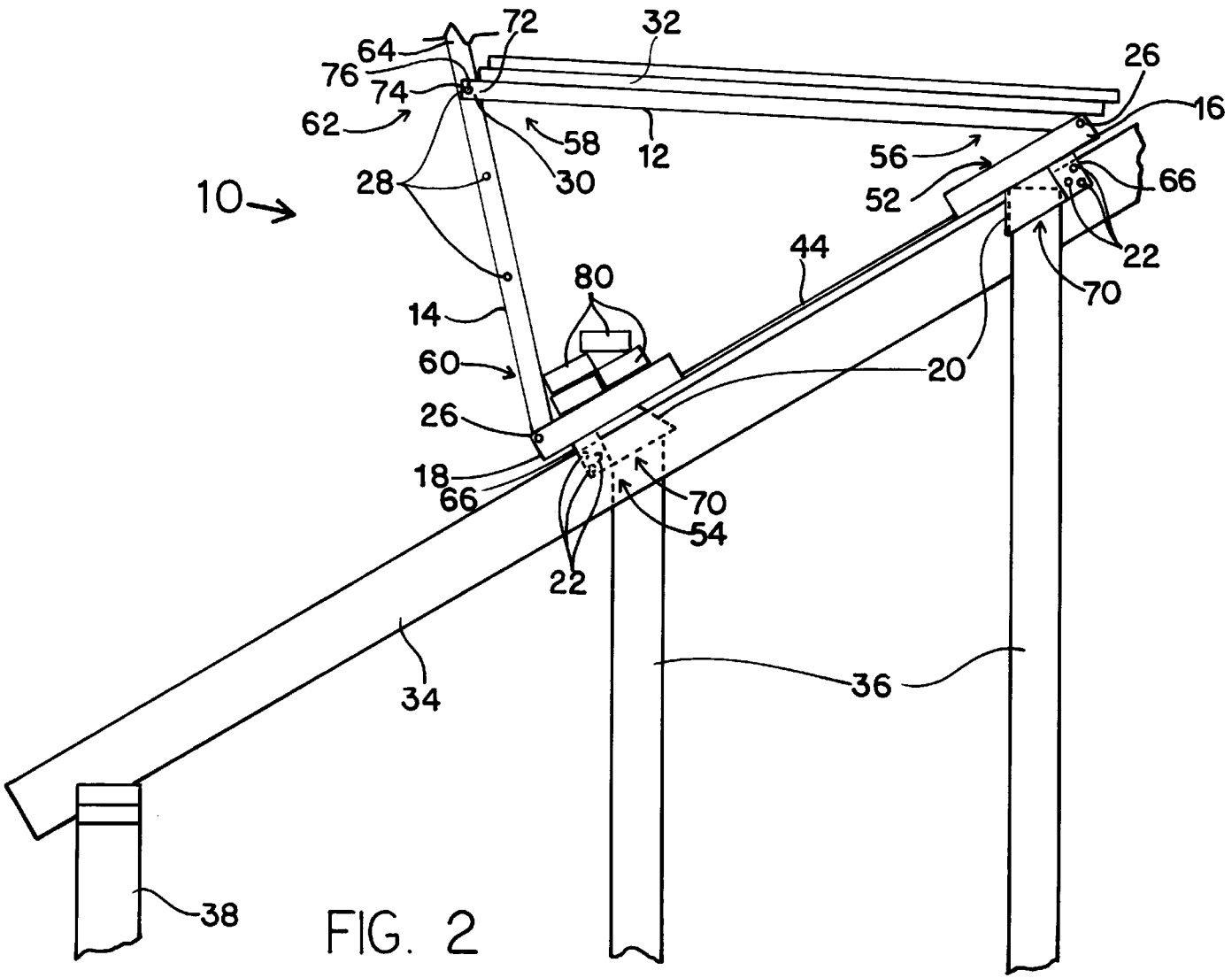
FIG. 2 is a side view of the roof mounted support bracket attached to a rafter or a truss, with braces installed.
Figure 3:
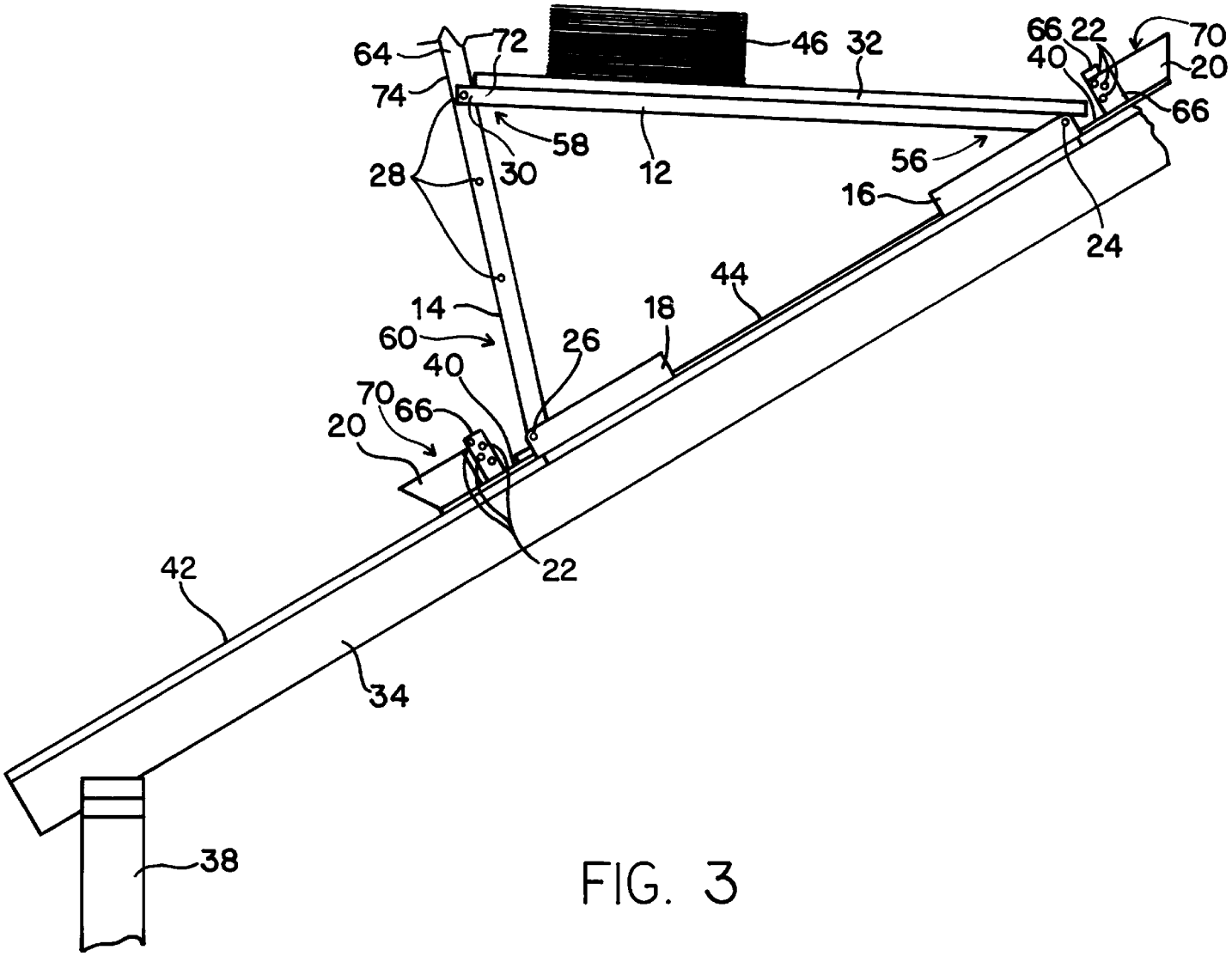
FIG. 3 is a side view of the roof mounted support bracket attached to the sloped surface of a roof.
Figure 4:
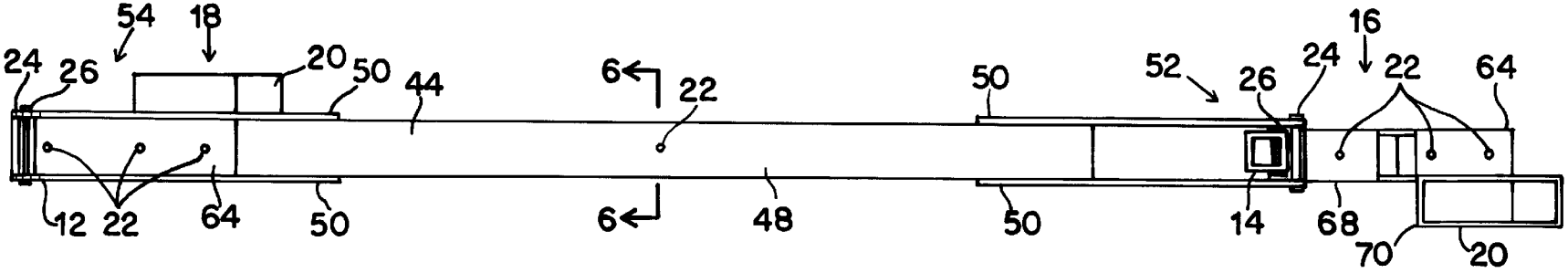
FIG. 4 is a top view of the roof mounted support bracket with one roof/truss attachment bracket oriented for attachment to a truss, and one oriented for attachment to the roof surface.
Figure 5:
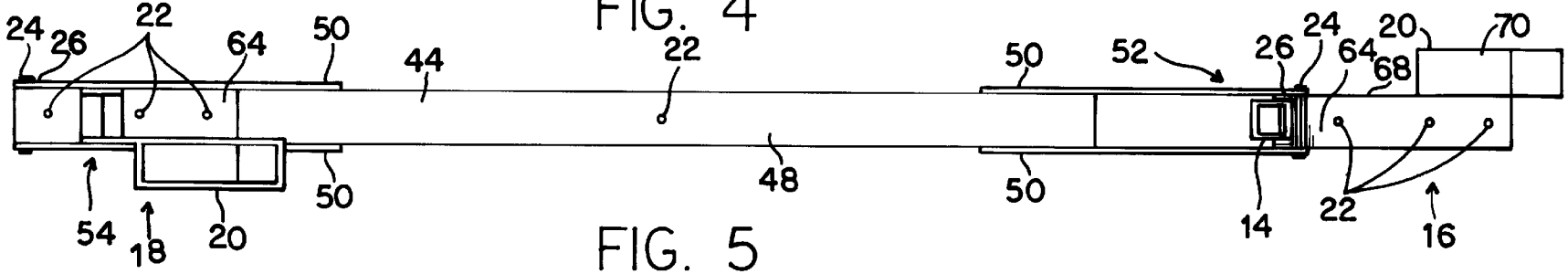
FIG. 5 is a bottom view of the roof mounted support bracket with one roof/truss attachment bracket oriented for attachment to a truss, and the other oriented for attachment to the roof surface.
Figure 6:
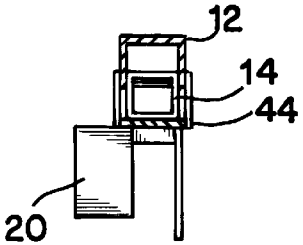
FIG. 6 is an end cross sectional view of the roof slope leg of the roof mounted support bracket, showing a roof/truss attachment bracket.

The preferred embodiment of the roof mounted support bracket 10 is a three sided structure comprising a roof slope leg 44, a horizontal leg 12, and a vertical leg 14, best shown in FIG. 2 and 3. The roof slope leg 44 is shown in side view in FIGS. 2 and 3, and top and bottom view in FIGS. 4 and 5. The roof slope leg 44 includes a metal strap 48 which is a flat piece of metal approximately 2 inches wide and 32 inches long, and is shown in FIGS. 4 and 5. The width of this piece is not critical, and the length can be made longer if a larger platform or an increased pitch roof is desired. At one end of metal strap 48 is attached first truss/roof attachment bracket 16, and at the other end of metal strap 48 is attached second truss/roof attachment bracket 18.

Figure 8:
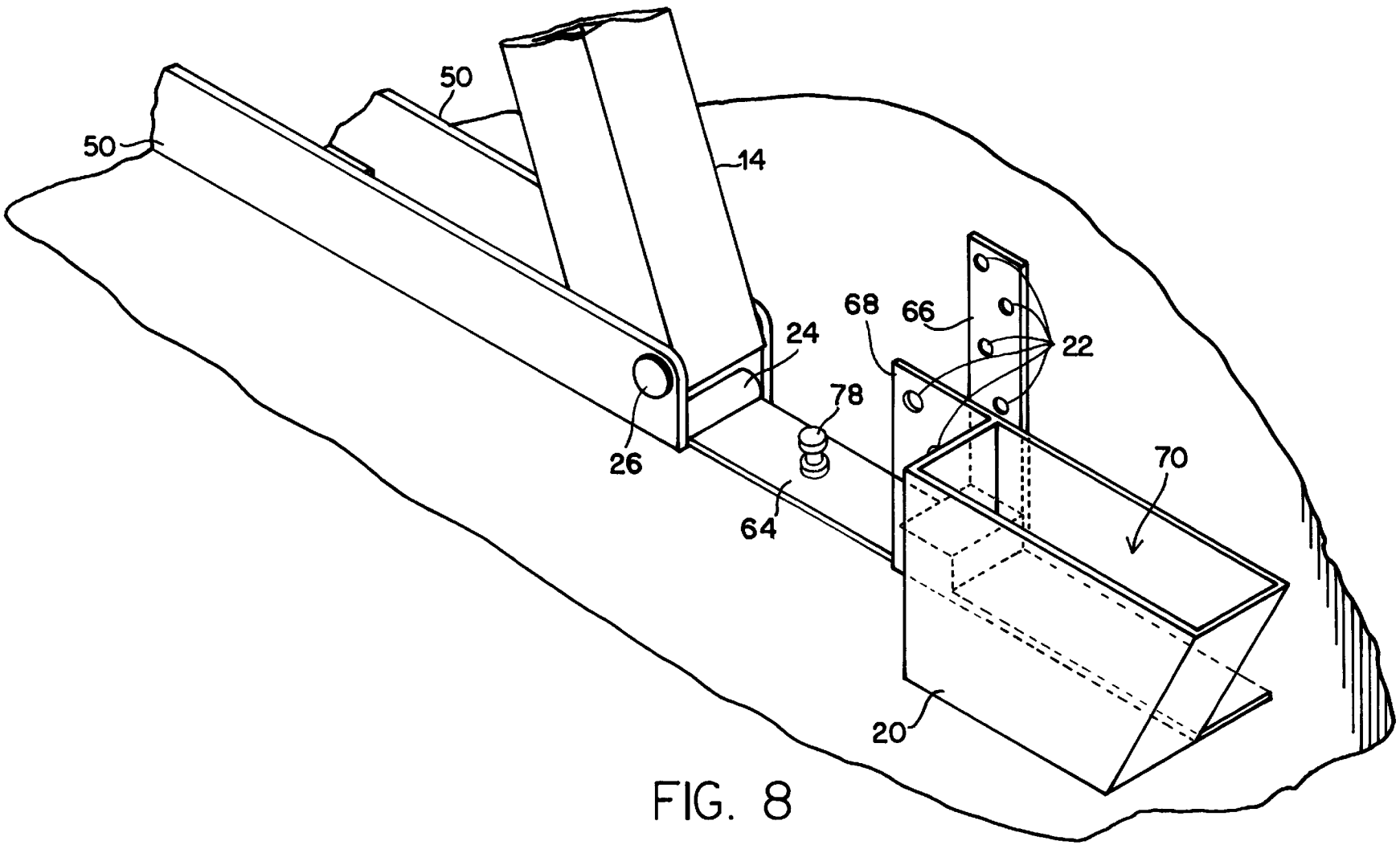
FIG. 8 is a perspective view of the roof-mounted support bracket mounted on a roof surface.

First and second truss/roof attachment bracket 16 and 18 each include hinge brackets 50. Hinge brackets 50 are mounted to metal strap 48 at a 90 degree angle to the metal strap 48. On the first truss/roof attachment bracket 16, a horizontal leg 12 is attached by a hinge 26 to the distal end of hinge bracket 50, as shown in FIGS. 4 and 5. On the second truss/roof attachment bracket 18, a vertical leg 14 is attached by a hinge 26 to the distal end of hinge bracket 50, as shown in FIG. 8.

The roof slope leg 44 has a first end 52 and a second end 54. The first end 52 of the roof slope leg 44 attaches to the first end 56 of the horizontal leg 12. The second end 54 of the roof slope leg 44 attaches to the first end 60 of the vertical leg 14. The second end 58 of the horizontal leg 12 attaches to the second end 62 of the vertical leg 14.

The metal strap 48 may optionally include nailing holes 22 along its length. At the first end 52 of the roof slope leg 44 is attached a first roof/truss attachment bracket 16 at the first hinge 24. At the second end 54 of the roof slope leg 44 is attached a similar second roof/truss attachment bracket 18. Only one will be described. The roof/truss attachment brackets 16 and 18 are shown in FIGS. 2, 3, 4, 5, and in detail in FIGS. 7 and 8.

Figure 7:
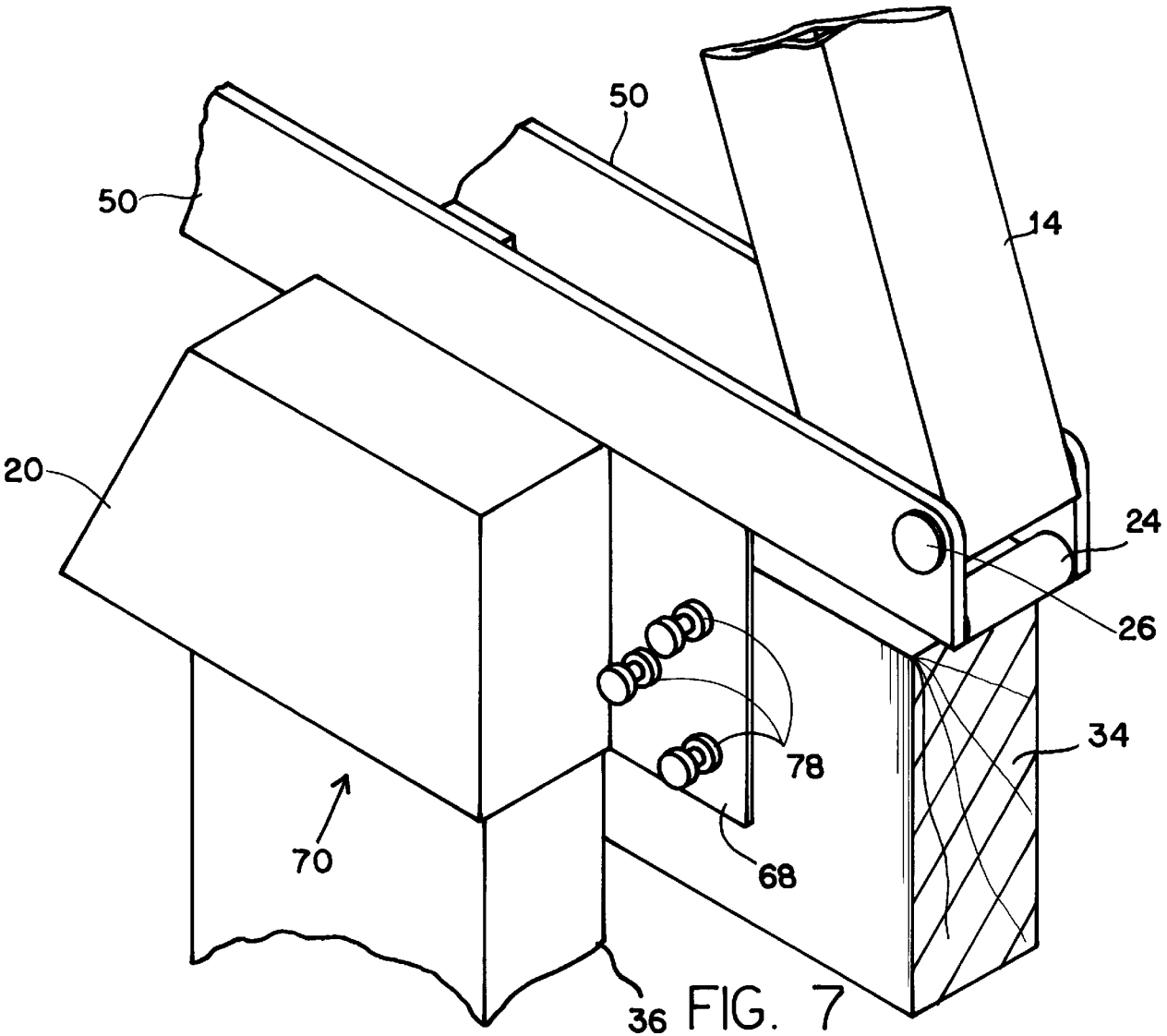
FIG. 7 is a perspective view of the roof-mounted support bracket mounted on a truss or rafter.

The roof/truss attachment bracket 16 includes a plate 64 which is a generally flat piece of metal approximately 2 inches in width and 8 inches in length. It attaches at one end to the first hinge 24. On one side of the plate 64 is a nailing piece 66. The nailing piece 66 is a piece of metal approximately 1½ inches wide by 14 inches long. In the nailing piece 66 are located several nailing holes 22. The nailing piece 66 and the nailing holes 22 are best shown in FIGS. 7 and 8. Attached to plate 64 on a side opposite nailing piece 66 is a brace receiver 20. Brace receiver 22 has a truss side 68 which includes nailing holes 22 and to which is attached a five sided pocket 70.

The horizontal leg 12 is preferably a piece of steel which is U shaped in cross section, although other configurations such as tubular and square in cross section would also function equally well. The horizontal leg 12 is approximately 47 inches long and attaches to the roof slope leg 44 at a second hinge 26, as shown in FIGS. 2 and 3. The first end 56 of the horizontal leg 12 attaches to the first end 52 of the roof slope leg 44. At the second end 58 of the horizontal leg 12 a Y yoke 72 is formed as shown in FIG. 2 with engagement holes 74.

Vertical leg 14 is preferably 46 inches in length and preferably has a square cross section, although other shapes could work equally well, such as tubular, channel, or I shapes. The first end 60 of vertical leg 14 attaches at a second hinge 26 to the second end 54 of roof slope leg 44. Along the length of vertical leg 14 are located slope adjustment holes 28. When slope adjustment holes 28 are aligned with the engagement holes 74 of the Y yoke 72 of the horizontal leg 12, an engagement pin 76 is inserted therethrough to lock the second end 58 of the horizontal leg 12 and the second end 62 of the vertical leg 14 together. The engagement pin can comprise a pin with a hole and a locking ring, a bolt and a nut, or other similar means of engagement.

In use, the roof mounted support bracket 10 is utilized during the construction of the roof of a building. After the trusses or rafters have been put in place and stabilized, the roof mounted support bracket 10 can be attached to the truss members or rafters 34. To do this the roof/truss attachment brackets 16 and 18 are rotated about the first hinges 24 so that the brace receivers 20 are oriented toward to floor of the building. This position is shown in FIG. 7. The brace receivers 20 in this position are also shown in FIG. 2. With the roof slope leg 44 parallel and in contact with a truss member or rafter 34, nails are driven through nailing holes 22 to secure the roof slope leg 44 to the truss member or rafter 34. Once the roof slope leg 44 is thus attached, the vertical leg 14 and the horizontal leg 12 are joined so that the Y yoke 72 of the horizontal leg 12 and it's engagement hole 74 align with slope adjustment holes 28 on the vertical leg 14. At the alignment of such holes which results in the horizontal leg 12 being in a generally horizontal attitude, an engagement pin 76 is inserted into the engagement hole 74 of the Y yoke 72 and the appropriate slope adjustment holes 28 of the vertical leg 14. This completes the assembly of one roof mounted support bracket 10. A second or multiple roof mounted support brackets 10 are similarly installed. When at least two roof mounted support brackets 10 are thus installed, a load bearing shelf 32 can be placed on the horizontal leg 12 of each roof mounted support bracket 10. This load bearing shelf 32 can be attached to the horizontal leg 12 by means of bolts, screws, pins, or other common means of attachment.

A support brace 36 can be inserted into the brace receivers 20 and placed on the floor of the building in order to provide additional support for the weight of materials placed on the load bearing shelf 34.

Once thus assembled, a fork lift from ground level can lift pallets of roofing material onto the load bearing shelf 32, from where it can be distributed over the surface of the roof and installed. Once sheathing material such as plywood has been laid over the entire roof, the roof mounted support brackets 10 must be removed so that sheathing material can be placed over those particular truss member or rafters 34.

When the sheathing material is placed over the entire roof, the roof mounting support brackets 10 can be reattached and reassembled so that the brace receivers 20 face away from the floor of the building, as shown in FIGS. 3 and 8. This allows the roof mounted support brackets 10 to be nailed to the sheathing of the roof rather than the trusses or the rafters 34.

While there is shown and described the present preferred embodiment of the invention, it is to be distinctly understood that this invention is not limited thereto but may be variously embodied to practice within the scope of the following claims.

I claim:

1. A roof-mounted support shelf, formed of two brackets each with two sides, each bracket for attachment to a truss member or to a roof surface, for supporting loads of construction materials, the support shelf comprising:

two brackets, each bracket comprising;

a horizontal leg with a first end and a second end for hinged attachment at the first end with a first truss/roof attachment bracket, and for adjustable attachment at the second end with a vertical leg, for support of a load bearing shelf;

a first truss/roof attachment bracket for hingedly attaching to the first end of the horizontal leg and for attachment to a truss member or to a roof surface;

a vertical leg with a first end and a second end, for hinged attachment at the first end with a second truss/roof attachment bracket, and for adjustable attachment at the second end with the second end of the horizontal leg;

a second truss/roof attachment bracket for hingedly attaching to the first end of the vertical leg and for attaching to a truss member or to a roof surface;

means of adjustably attaching the second end of the horizontal leg to the second end of the vertical leg;

one or more brace receivers attached to the first and or second truss/roof attachment bracket and configured for receiving a weight supporting brace from below said roof-mounted support bracket; and a load bearing shelf for attachment to said two brackets, for supporting said loads of construction materials.

2. The roof mounted support shelf of claim 1 in which the means of adjustably attaching the second end of the horizontal leg with the second end of the vertical leg is a hole and pin arrangement.

3. A roof mounted support shelf formed of two brackets each with three sides, for attaching to a truss member or to a roof surface, for supporting loads of construction materials, comprising:

two brackets, each bracket comprising a roof slope leg with a first end and a second end for hinged attachment at the first end with a horizontal leg and for hinged attachment to a first truss/roof attachment bracket, and hinged attachment at the second end with the first end of a vertical leg and for hinged attachment to a second truss/roof attachment bracket;

a horizontal leg with a first end and a second end for hinged attachment at the first end with the first end of the roof slope leg, and for adjustable attachment at the second end with a vertical leg, for support of a load bearing shelf;

a first truss/roof attachment bracket for hinged attachment to the first end of the roof slope leg and to a truss member or roof surface;

a vertical leg with a first end and a second end, for hinged attachment at the first end with the second end of the roof slope leg, and for adjustable attachment at the second end with the second end of the horizontal leg;

a second truss/roof attachment bracket for hinged attachment to the second end of the roof slope leg and to a truss member or roof surface;

a means of attaching the second end of the horizontal leg to the second end of the vertical leg; and one or more brace receivers hingedly attached to the roof slope leg, and configured for receiving a weight supporting brace from below said roof-mounted support shelf; and a load bearing shelf for attachment to said two brackets, for supporting said loads of construction materials.

4. The roof mounted support shelf of claim 3 in which the means of adjustably attaching the second end of the horizontal leg with the second end of the vertical leg is a hole and pin arrangement.

5. A roof mounted support shelf formed of two brackets each with three sides, for attaching to a truss member or to a roof surface, for supporting loads of construction material, comprising:

two brackets, each bracket comprising;

a generally straight roof slope leg with a first end and a second end for hinged attachment at the first end with a first end of a horizontal leg and for hinged attachment to a first truss/roof attachment bracket, and hinged attachment at the second end with the first end of a vertical leg and for hinged attachment to a second truss/roof attachment bracket;

a horizontal leg with a first end and a second end for hinged attachment at the first end with the first end of the roof slope leg, and for adjustable attachment at the second end with a vertical leg by use of a Y yoke on the second end of the horizontal leg, for support of a load bearing shelf;

a first truss/roof attachment bracket for hinged attachment to the first end of the roof slope leg and for three sided engagement to a truss member or one sided engagement with a flat roof surface;

a vertical leg with a first end and a second end, for hinged attachment at the first end with the second end of the roof slope leg, and for adjustable attachment at the second end with the second end of the horizontal leg by the use of holes in the vertical leg and corresponding holes in the Y yoke of the horizontal leg and an interconnecting pin;

a second truss/roof attachment bracket for hinged attachment to the second end of the roof slope leg and for three sided engagement to a truss member or one sided engagement to a flat roof surface;

one or more brace receivers hingedly attached to the roof slope leg and configured for receiving an end of a weight bearing support brace from below said roof-mounted support shelf; and a load bearing shelf for attachment to said two brackets, for supporting loads of construction materials.

* * * * *